US006786745B1

(12) United States Patent
Huang

(10) Patent No.: US 6,786,745 B1
(45) Date of Patent: Sep. 7, 2004

(54) SAFETY PROTECTIVE COVER FOR SOCKET RECEPTACLES

(76) Inventor: Chyong-Yen Huang, P.O. Box No. 6-57, Junghe, Taipei 235 (TW)

( * ) Notice: Subject to any disclaimer, the term of this patent is extended or adjusted under 35 U.S.C. 154(b) by 17 days.

(21) Appl. No.: 10/642,208

(22) Filed: Aug. 18, 2003

(51) Int. Cl.[7] ..... H01R 13/44
(52) U.S. Cl. ..... 439/137; 439/373
(58) Field of Search ..... 439/133–140, 439/145, 149, 113, 345, 373; 174/67, 53, 66

(56) References Cited

U.S. PATENT DOCUMENTS 4,544,219 A * 10/1985 Barkas ..... 439/137
4,707,042 A * 11/1987 Haden ..... 439/140
4,822,290 A * 4/1989 Cauley et al. ..... 439/137
4,867,693 A * 9/1989 Gizienski et al. ..... 439/137
4,867,694 A * 9/1989 Short ..... 439/137
5,006,075 A * 4/1991 Bowden, Jr. ..... 439/137
6,149,446 A * 11/2000 Yu ..... 439/137
6,217,353 B1 * 4/2001 Yu-Tse ..... 439/145
6,537,089 B1 * 3/2003 Montague ..... 439/145

* cited by examiner

*Primary Examiner*—Gary Paukmen
*Assistant Examiner*—Edwin A. Leon

(57) ABSTRACT

A safety protective cover for socket receptacles includes an upper housing, a sliding base, a first elastic member, a second elastic member, and a lower housing. The upper and lower housings are provided with receptacles, respectively. The sliding base is capable of vertical and horizontal movements between the upper and lower housings, and has elastic restoring forces. The sliding base further has stopping members that can be extended into the receptacles of the housings. When the stopping members of the cover are not simultaneously pushed away from the receptacles, the other stopping member not being pushed away blocks in the receptacle to stop horizontal displacement of the sliding base, thereby prohibiting an alien object from pushing away the stopping member and entering the socket.

1 Claim, 9 Drawing Sheets

SAFETY PROTECTIVE COVER FOR SOCKET RECEPTACLES

BACKGROUND OF THE INVENTION (a) Field of the Invention

The invention relates to a safety protective cover for socket receptacles, and more particularly, to a safety protective cover having a sliding base capable of vertical and horizontal movements between upper and lower housings of a socket, such that stopping members therein are blocked in receptacles at the upper housing for prohibiting invasions of alien objects and thus preventing accidental electric shocks.

(b) Description of the Prior Art

A common wall socket or an extension wire socket is generally provided with at least one set of receptacles, wherein each set of receptacles has two or three receptacles. However, several drawbacks are found after studying the aforesaid prior socket. First of all, the "open" socket lacks protective measures, and accidental electric shocks are repeated occurrences among children caused by curiosity. Secondly, the prior socket is an open structure as described, with conductive straps at an interior thereof mostly being conductive materials such as copper. These conductive materials are often formed with aerugo resulted from humidity for being exposed in air over long periods of time, or accumulated with dust, and hence conductive efficiencies thereof may become affected. Therefore, the prior socket has potential hazards to a certain degree, and can hardly be accounted as an ideal design when put to use. To overcome the aforesaid shortcomings, the inventor provided a structure disclosed by the U.S. Pat. No. 6,537,088. Referring to FIG. 8, the structure comprises a socket housing having a protective cover D1 capable of elastic horizontal movements; and two stopping members D2 each having an inclined plane and located at a top portion of the protective cover D1, with the two stopping members D2 blocking below receptacles D3. When pins B1 of a plug B are inserted into the receptacles D3, the inclined planes of the two stopping members D2 are simultaneously displaced to further horizontally move the entire protective cover D1, so as to conduct the plug B with conductive straps D4 by completely inserting the plug B into the receptacles D3. When an alien object C is inserted into one of the receptacles D3 as shown in FIG. 9, the alien object C imposes a downward force at one end of the protective cover D1. Leverage is formed from force received at one end of the protective cover D1, and the stopping member D2 at the other end of the protective cover D1 is lifted to block in the receptacle D3. As a result, the protective cover D1 fails to displace horizontally with the protective cover D1 remaining blocked in the receptacles 3, thereby preventing potential hazards by forbidding the alien object C from coming into contact and conducting with the conductive straps D4. This prior invention indeed offers practical excellences. However, for that the two stopping members D2 of the protective cover D1 are located below the two receptacles D3, consumers so happen to notice the two stopping members D2 have inclined planes when observing the receptacles D3 in an inward direction from an exterior of the socket D, and the protective cover D1 is often mistaken to have unqualified assembly by being seemingly slanted. Therefore, purchasing concerns are incurred.

SUMMARY OF THE INVENTION

To overcome the aforesaid difficulty, the object of the invention is to provide a safety protective cover for socket receptacles, in that the safety protective cover is capable of preventing alien objects from entering one of the receptacles and offering dust-proof effects. More particularly, upper edges of stopping members of the safety protective cover are flat in shape, and appear as evenly assembled when viewed from an exterior. The stopping members are free from slanting appearances and are prevented from being mistaken as having unqualified assembly, and the socket is provided with enhanced texture overall.

The invention comprises an upper housing, a sliding base, a first elastic member, a second elastic member, and a lower housing. The upper housing has receptacles. The sliding base is disposed below the upper housing; and has pushing members, and stopping members at an upper portion thereof. The first elastic element is accommodated at the sliding base to provide the sliding base with horizontal elastic restoring forces. The second elastic member has elastic terminals that are supported at a lower edge at a middle section of the sliding base to provide the sliding member with vertical elastic restoring forces. The lower housing is joined with the upper housing; and has receptacles, and slide-guide members for producing horizontal movements when coming into contact with the pushing members of the sliding base. When the stopping members of the sliding base are simultaneously pushed away from the receptacles at the upper housing, the sliding base suppresses the second elastic member to move vertically in a downward direction. When the pushing members come into contact with slide-guide inclined planes of the slide-guide members, the sliding base keeps moving to force the stopping members to deviate out of the receptacles at the upper housing. However, when the stopping members of the sliding base are not simultaneously pushed away from the receptacles, the sliding base regards one of the elastic terminals of the second elastic members as a fulcrum, such that the sliding base fails to move horizontally by having the stopping member not being pushed away remain blocked in the located receptacle.

DETAILED DESCRIPTION OF THE PREFERRED EMBODIMENTS

To better understand the invention, detailed descriptions shall be given with the accompanying drawings hereunder.

Figure 1:
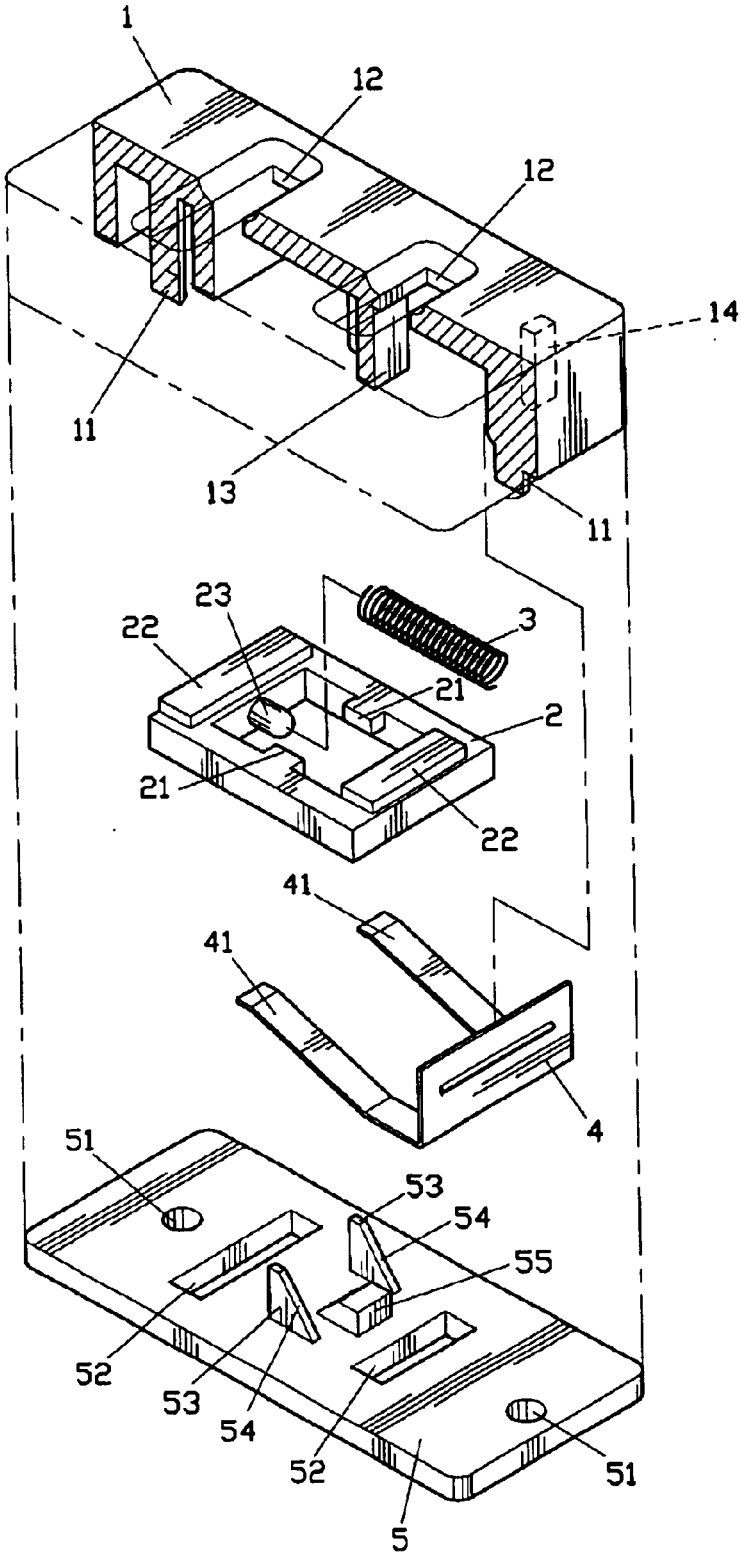
FIG. 1 shows an exploded elevational view according to the invention.

Referring to FIG. 1, the invention comprises an upper housing 1, a sliding base 2, a first elastic member 3, a second elastic member 4, and a lower housing 5.

The upper housing 1 has two lodge posts 11, two corresponding receptacles 12 at an outer side of the upper housing 1, a downwardly formed retaining member 13 between the two receptacles 12, and a locating portion 14 at one side of one of the receptacles 12.

The sliding base 2 disposed in the upper housing 1 is a hollow frame body; and has corresponding pushing members 21 at a middle section thereof, two upwardly disposed stopping members 22 at two upper edges thereof, with upper edges of the stopping members 22 being flat in shape, and a horizontal projecting pillar 23 at one inner edge thereof.

The first elastic member 3 is accommodated around the projecting pillar 23, and can be a spring for offering the sliding base 2 with horizontal elastic restoring forces.

The second elastic member 4 is fixed at the locating portion 14 at the upper housing 1, and can be a spring for offering the sliding base 2 with vertical elastic restoring forces. The second elastic member 4 further has two elastic terminals 41.

The lower housing 5 is joined at a lower edge of the upper housing 1 by means of inset, screwing or ultrasonic. The lower housing 5 has two lodge openings 51 with two receptacles 52 in between, two slide-guide members 53 located between the two receptacles 52 and corresponding to the pushing members 21 of the sliding base 2, and an obstructing member 55 between the two slide-guide members 53, wherein each of the two slide-guide members 53 is provided with an inclined plane 54 for guiding sliding movements.

Figure 2:
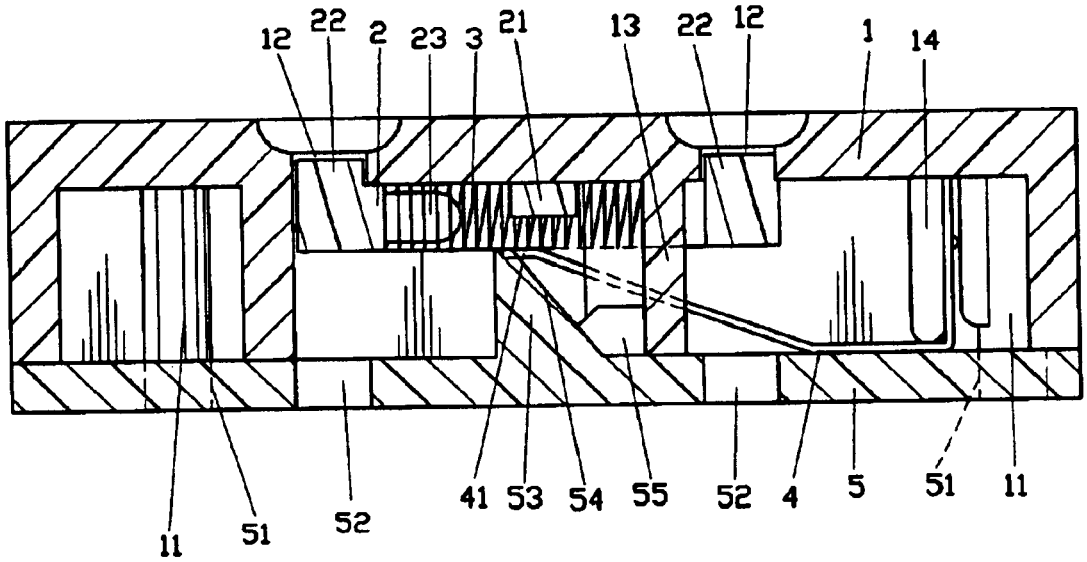
FIG. 2 shows a sectional view according to the invention.

Referring to FIG. 2, for assembly, the first elastic member 3 is accommodated around the projecting pillar 23 of the sliding base 2. The sliding member 2 is placed at an inner side of the upper housing 1, such that the two stopping members 22 of the sliding base 2 are blocked in the two receptacles 12 at the upper housing 1. An open end of the projecting pillar 23 of the sliding base 2 is butted against the retaining member 13 at the upper housing 1, whereas the second elastic member 4 is mounted at the locating portion 14 of the upper housing 1. The two elastic terminals 41 of the second elastic member 4 are pushed in an upward direction against a lower edge of the middle section of the sliding base 2, so as to enable the stopping members 22 to constantly block in the receptacles 12 at the upper housing 1. The two lodge openings 51 of the lower housing 5 are inserted with the two lodge post 11 of the upper housing 1, thereby joining the upper and lower housings 1 and 5.

Figure 3:
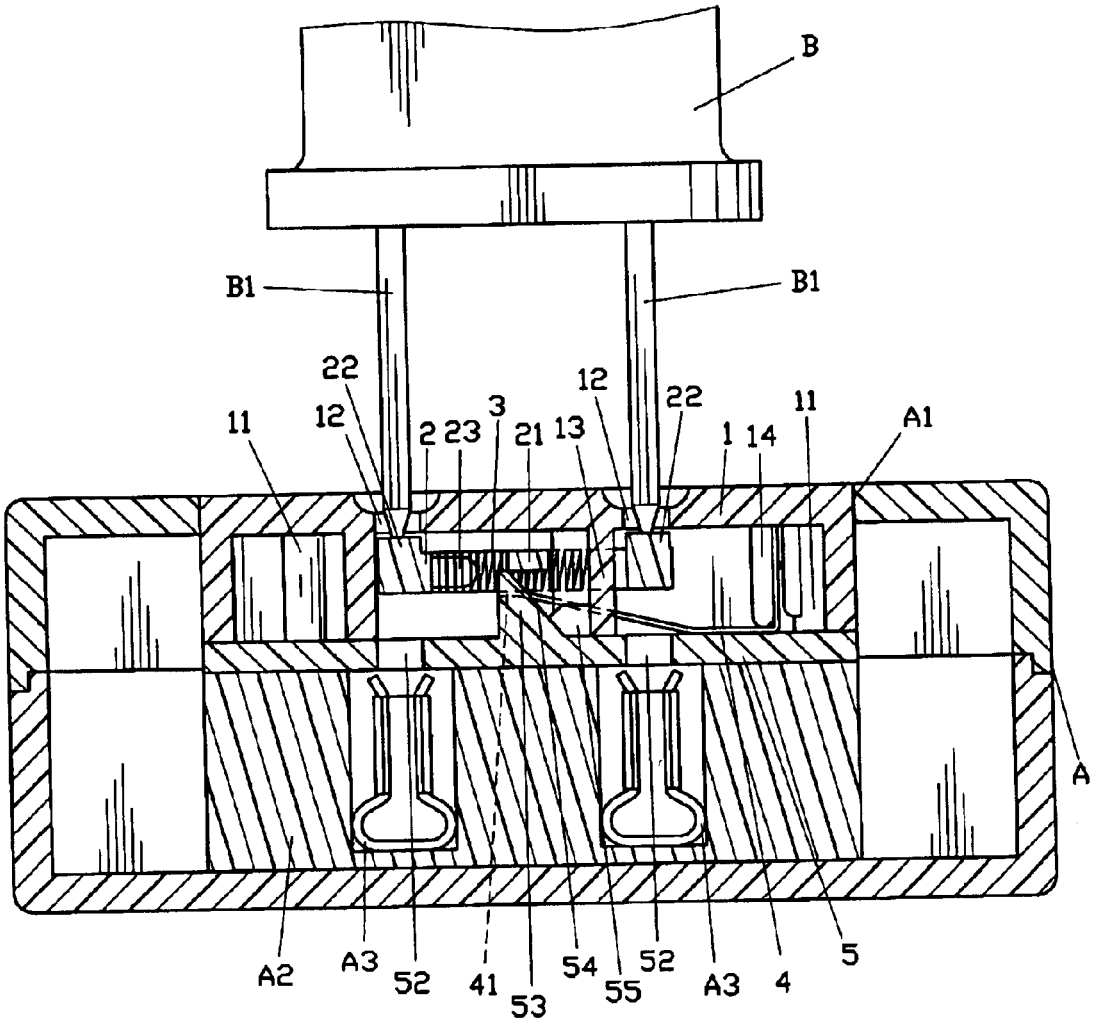
FIG. 3 shows a schematic view illustrating vertical movements of the sliding base according to the invention.
Figure 4:
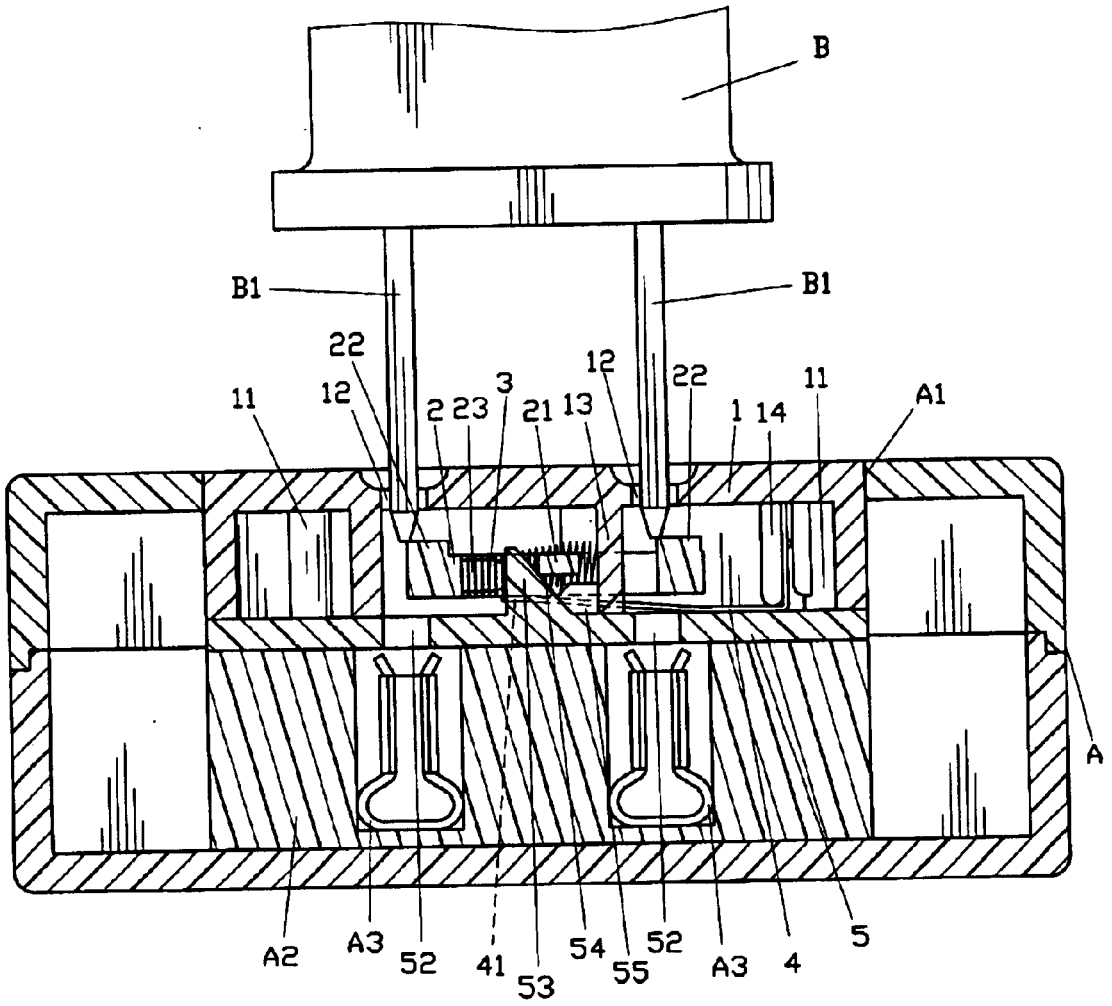
FIG. 4 shows a schematic view illustrating horizontal movements of the sliding base according to the invention.
Figure 5:
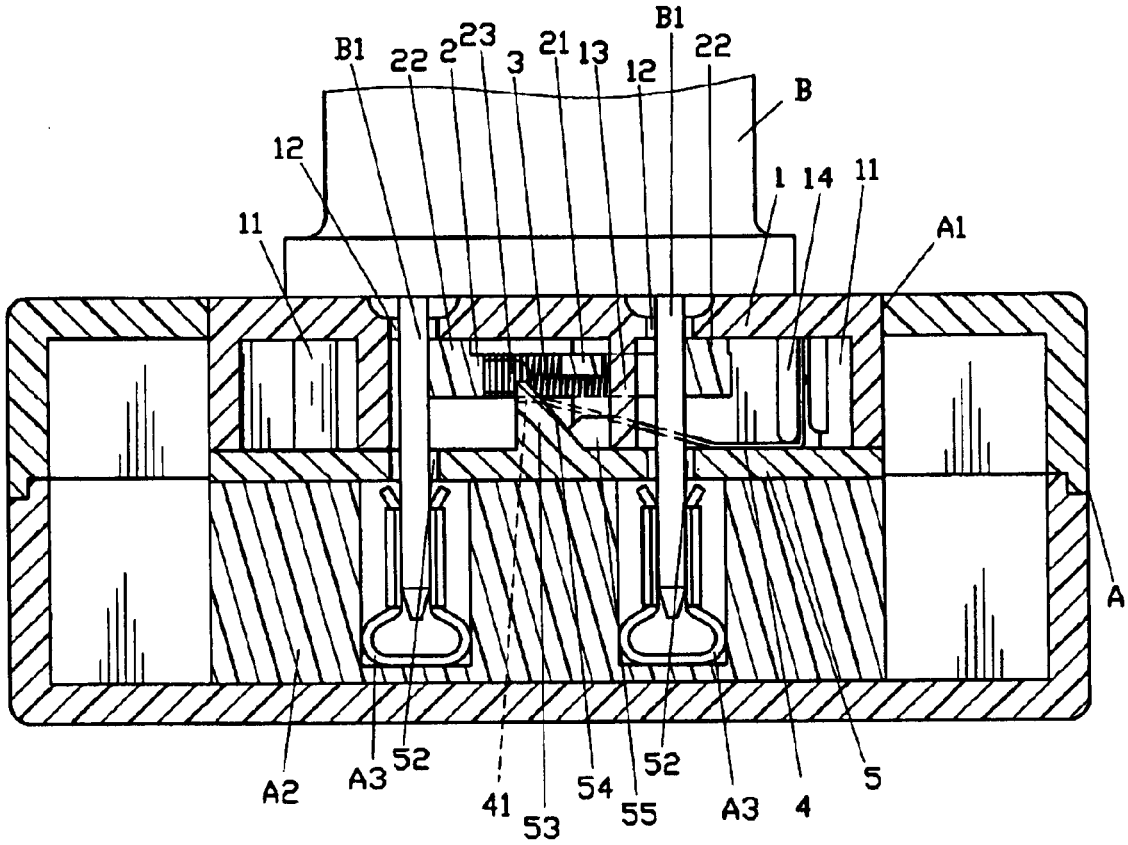
FIG. 5 shows a schematic view illustrating the pins being entirely inserted into the conducting straps according to the invention.

Referring to FIGS. 3 and 4, to use the aforesaid structure, the assembled upper and lower housings 1 and 5 are fixed into a fastening recess A1 of a socket A. The receptacles 12 and 52 at the upper and lower housings 1 and 5 are aligned with conducting straps A3 at a housing A2 in the socket A, and two pins B1 of a plug B are inserted into the two receptacles 12 at the upper housing 1. When the pins B1 are inserted, the two stopping members 22 of the sliding base 2 are pushed to simultaneously move vertically in a downward direction, and to further suppress against the two elastic terminals 41 of the second elastic member 4. When the pins B1 continue to push downward, the sliding base 2 moves downward such that the two stopping members 22 are departed from the two receptacles 12. The two pushing members 21 of the sliding base 2 immediately come into contact with the inclined planes 54 at the two slide-guide members 53 of the lower housing 5 to slide. Thus, apart from moving vertically in a downward direction, the sliding base 2 also horizontally displaces to suppress against the first elastic member 3. The first elastic member 3 becomes suppressed and also moves downward at the same Ume. However, the first elastic member 3 is not disengaged out of the retaining member 13 for being stopped by obstructing member 55 of the lower housing 5. When the sliding base 2 move horizontally to an extent that the two stopping members 22 are entirely departed from positions below the two receptacles 12, the two pins B1 of the plug B are allowed to pass through the two receptacles 52 of the lower housing 5, so as to become inserted into the conducting straps A3 at the housing A2 of the socket A and electrically conducted for providing normal power supply as shown in FIG. 5. When the pins B1 of the plug B are withdrawn, the sliding base 2 is pushed to displace horizontally using restoring forces of the first elastic member 3, and is also pushed vertically to reposition using restoring forces of the second elastic member 4, thereby restoring and blocking the two stopping members 22 of the sliding base 2 in the receptacles 12 at the upper housing 1.

For that the upper edges of the two stopping members 22 of the sliding base 2 are flat in shape, the stopping members 22 appear properly assembled in the receptacles 12 when viewed from the exterior of the receptacles 12 of the socket A, and are not mistaken as being slanted from unqualified assembly. Thus, texture of the socket A is enhanced overall.

Figure 6:
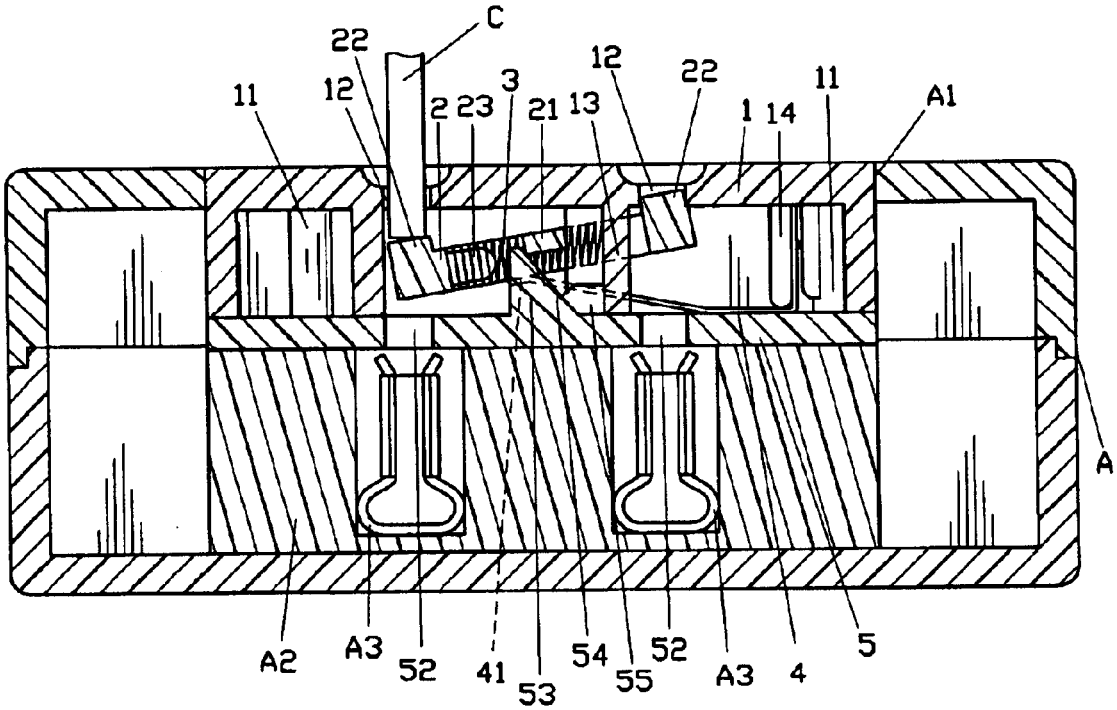
FIG. 6 shows a schematic view illustrating the invention forbidding entry of an alien object.

Referring to FIG. 6, when an alien object C is inserted into one of the receptacles 12 at the upper housing 11, one of the stopping members 22 on the same side is pushed to move downward, and the middle section of the sliding base 2 forms leverage relative to the elastic terminal 41 of the second elastic member 4 as a fulcrum. The other end of the sliding base 2 is lifted, and the stopping member 22 at the lifted end is blocked in the other receptacle 12, such that the sliding base 2 fails to keep on moving vertically in a downward direction. As a result, the stopping member 22 being pushed by the alien object C is not successfully moved away and still remains blocked below the alien object C. The alien object C is not proceeded downward, and hence not penetrated through the receptacle 52 at the lower housing 5 and inserted into the conducting strap A3 at the housing A2 for conductance.

Figure 7:
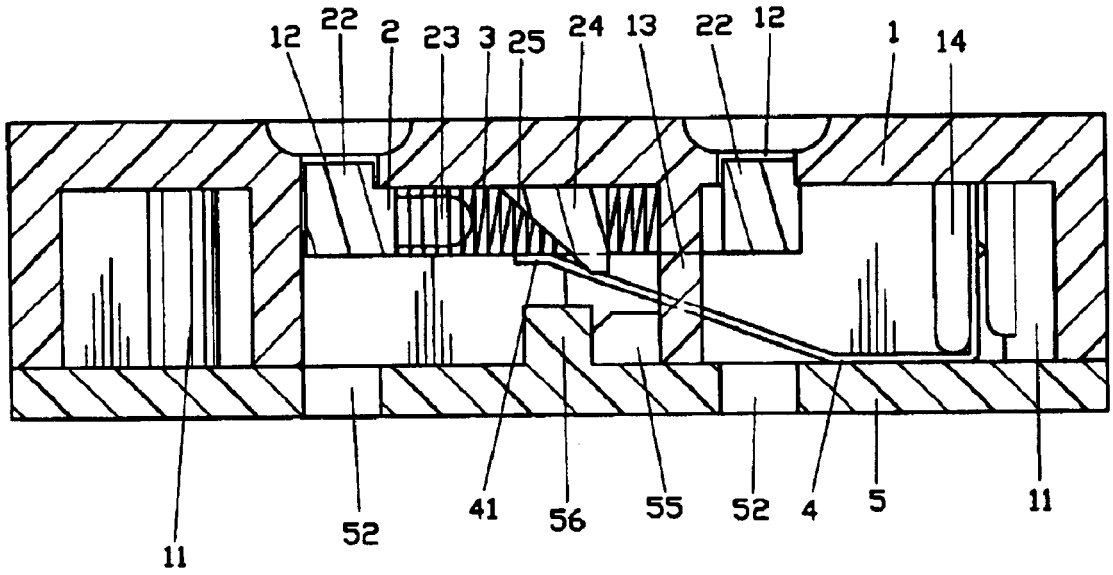
FIG. 7 shows a schematic view of another embodiment according to the invention.
Figure 8:
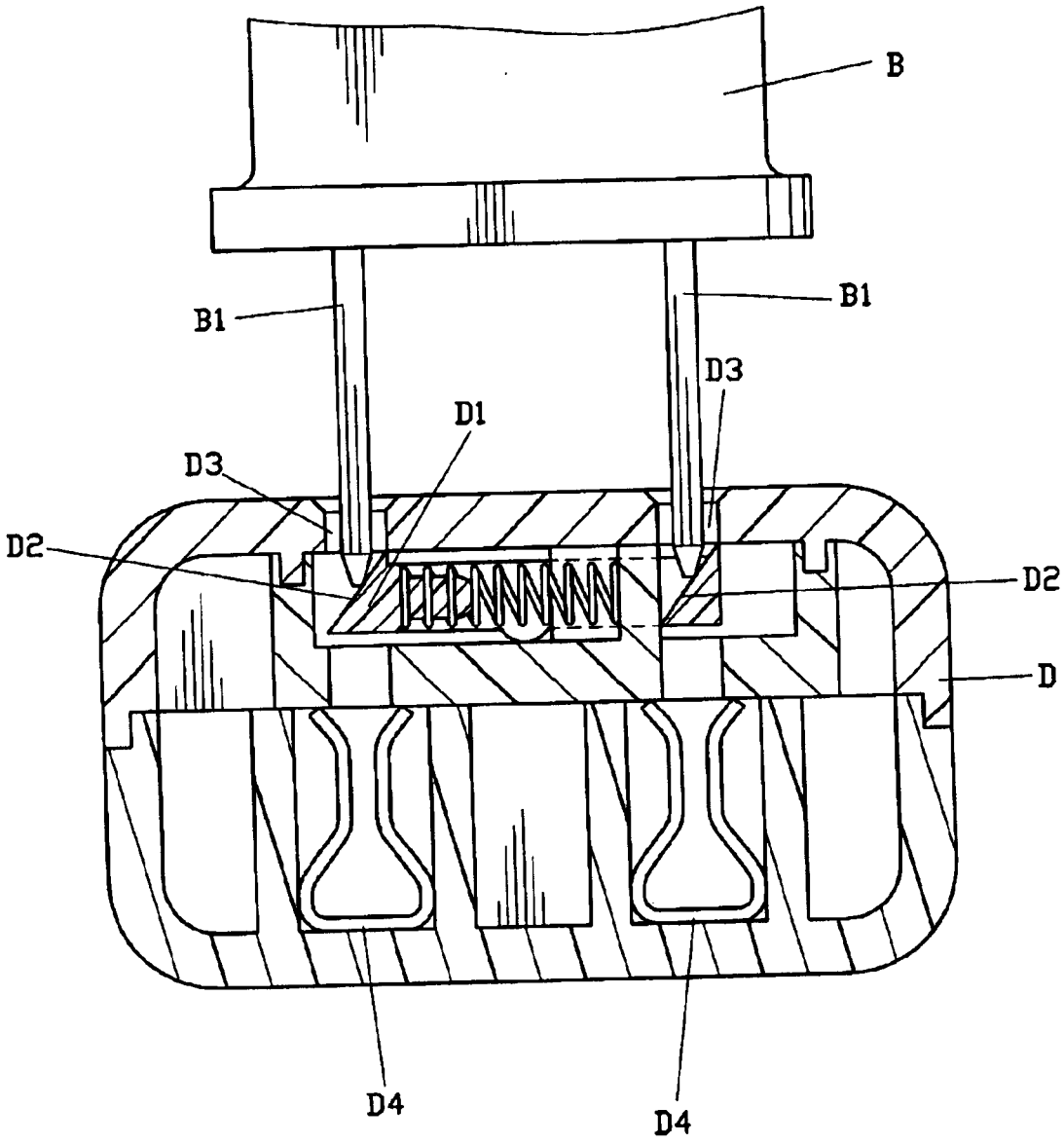
F I G. 8 Prior Art
FIG. 8 shows a conventional schematic view illustrating a prior socket structure.
Figure 9:
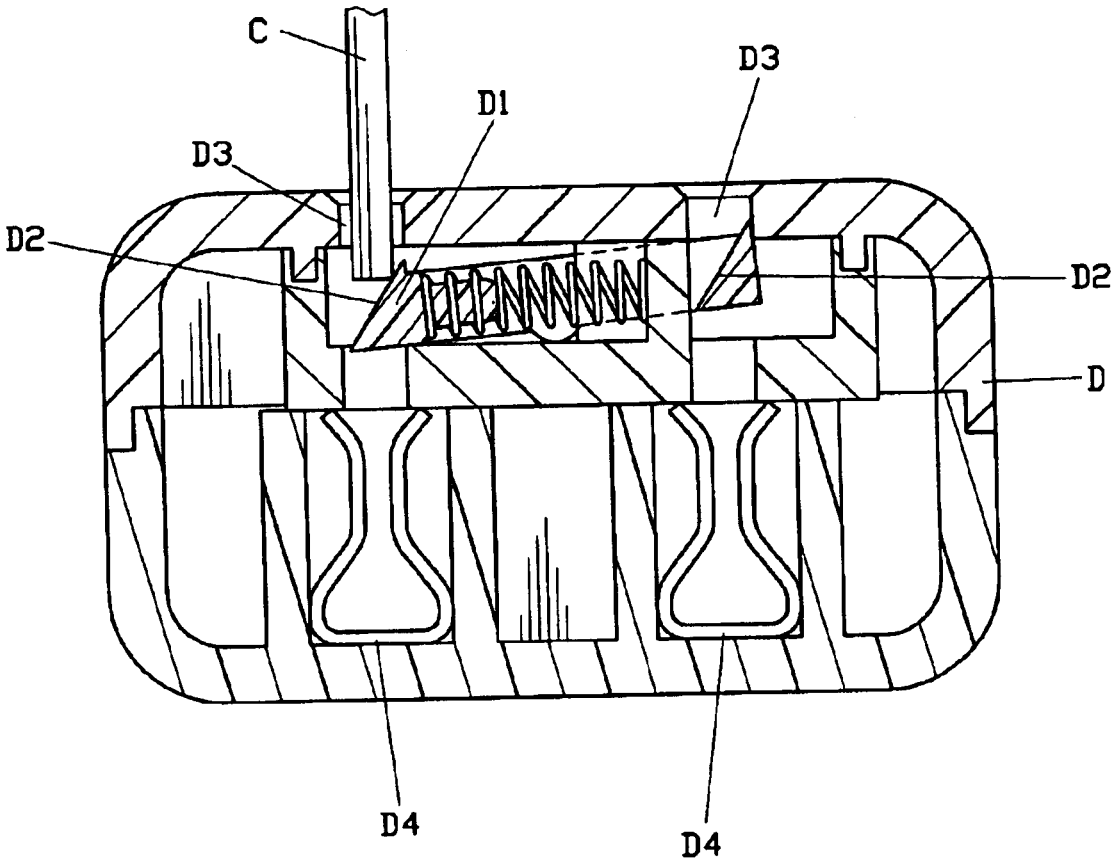
FIG. 9 Prior Art
FIG. 9 shows a schematic view illustrating the prior invention forbidding entry of an alien object.

Referring to FIG. 7 showing another embodiment according to the invention, the middle section of the sliding base 2 is provided with a slide-guide member 24 having an inclined plane 25 for guiding sliding movements. The lower housing 5 is provided with a pushing member 56 that comes into contact with the inclined plane 25 of the slide-guide member 24 to produce horizontal displacement, thereby accomplishing effects as those of the first embodiment.

In the aforesaid two embodiments, the upper housing 1 and the lower housing 5 may be formed at other objects depending on actual needs. In other implementations, as long as an interlining layer is present between the upper housing 1 and the lower housing 5 in order to assemble the sliding base 2, the first elastic member 3 and the second elastic member 4, the implementations are feasible.

Conclusive from the above, the invention has the following excellences:

1. When the sliding base according to the invention is opened under normal circumstances, the sliding base first performs vertical movements in a downward direction, followed by horizontal displacement. In addition, the stopping members of the base member for blocking in the receptacles are free from any inclined planes needed for assisting horizontal displacement of the sliding base, and therefore the stopping members are provided with flat upper edges. When viewing from the exterior of the receptacles, the stopping members are properly blocked in the receptacles while providing enhanced texture.

2. When one of the receptacles according to the invention is invaded by an alien object, the sliding base is not horizontally displaced, with the stopping member remaining blocked in the other receptacle not being inserted by the alien object. Consequently, invasions of alien objects are effective prohibited, thereby preventing accidental electric shocks and thus offering outstanding safety.

It is of course to be understood that the embodiments described herein are merely illustrative of the principles of the invention and that a wide variety of modifications thereto may be effected by persons skilled in the art without departing from the spirit and scope of the invention as set forth in the following claims.

What is claimed is:

1. A safety protective cover for socket receptacles comprising:

an upper housing having receptacles;

a sliding base located below the upper housing; and having pushing members, and stopping members at an upper side thereof for corresponding to the receptacles at the upper housing;

a first elastic member providing the sliding base with horizontal elastic restoring forces;

a second elastic member having elastic terminals, wherein the elastic terminals support a lower edge of a middle section of the sliding base to provide the sliding base with vertical elastic restoring forces; and a lower housing located below the upper housing; forming an interlining space with the upper housing; and having receptacles, and slide-guide members corresponding to the pushing members, wherein each slide-guide member further has an inclined plane for guiding sliding movements; and the characteristics being that, when the stopping members of the sliding base are simultaneously pushed away from the receptacles at the upper housing, the sliding base suppresses the second elastic member to move vertically in a downward direction, and at an instant that the pushing members come into contact with the slide-guide inclined planes of the slide-guide members, the sliding base continues to displace horizontally to force the stopping members out of the receptacles at the upper housing; when the stopping members are not simultaneously pushed away from the receptacles, the sliding base regards one of the elastic terminals of the second elastic member as a fulcrum, such that the sliding base fails to perform horizontal displacement by having other stopping member not being pushed away from the receptacle remain blocked in the receptacle.

* * * * *